US005133646A

United States Patent [19]

Nelson, Sr.

[11] Patent Number: 5,133,646

[45] Date of Patent: Jul. 28, 1992

[54] ANTISURGE APPARATUS FOR ELIMINATING SURGES IN COMPRESSED AIR OUTPUT BY A COMPRESSOR

[75] Inventor: Thomas A. Nelson, Sr., San Diego, Calif.

[73] Assignee: Sundstrand Corporation, Rockford, Ill.

[21] Appl. No.: 611,123

[22] Filed: Nov. 9, 1990

[51] Int. Cl.[5] ..... F04B 49/08

[52] U.S. Cl. ..... 417/307; 417/300; 60/468

[58] Field of Search ..... 417/300, 307; 60/468

[56] References Cited

U.S. PATENT DOCUMENTS

| | | | |
|---|---|---|---|
| 1,215,071 | 2/1917 | Steedman | 417/299 |
| 2,459,000 | 1/1949 | Morris | 417/300 |
| 2,977,971 | 4/1961 | Ruhl | 137/117 |
| 3,470,869 | 10/1969 | Auwerther | 137/117 |
| 3,574,474 | 4/1971 | Lukacs | 417/307 |
| 3,689,197 | 9/1972 | Berle et al. | 417/307 |
| 3,698,839 | 10/1972 | Distefano | 417/299 |
| 3,732,039 | 5/1973 | Carothers, Jr. | 417/300 |
| 4,548,036 | 10/1985 | Matsuda et al. | 60/468 |
| 4,731,999 | 3/1988 | Niemiec | 417/307 |

OTHER PUBLICATIONS

Stewart, Harry, *Practical Guide to Fluid Power*, (Theodore Audel & Co., Indianapolis, Ind. 1968) pp. 276–281.

*Primary Examiner*—Richard A. Bertsch
*Assistant Examiner*—Michael I. Kocharov
*Attorney, Agent, or Firm*—Antonelli, Terry, Stout & Kraus

[57] ABSTRACT

An antisurge apparatus for eliminating surges in compressed air output by a compressor. The compressed air output by the compressor is divided into a first portion of compressed air being supplied to a dump tube for dumping the first portion of compressed air as excess compresssed air to avoid surge and a second portion of compressed air being supplied to apparatus which makes use of the compressed air. The antisurge apparatus includes apparatus for sensing a change in flow of the second portion of compressed air output by the compressor and supplying a flow change signal proportional to flow indicating the amount of the change in flow and apparatus for controlling the amount of the first portion of compressed air being supplied to the dump tube in response to the flow change signal. The antisurge apparatus eliminates compressor surges while minimizing the amount of air dumped as the system or apparatus demand for compressed air increases.

10 Claims, 2 Drawing Sheets

ANTISURGE APPARATUS FOR ELIMINATING SURGES IN COMPRESSED AIR OUTPUT BY A COMPRESSOR

TECHNICAL FIELD

The present invention relates to antisurge valves. used on compressors wherein a portion of the compressed air output by the compressor is disposed during compressor operation for compressor surge prevention. More particularly, the present invention relates to antisurge apparatus for controlling the amount of compressed air output by a compressor being dumped for compressor surge prevention during increased demand for compressed air. The increased demand for compressed air is caused by the sudden start-up of additional apparatus or systems using the compressed air or increased operation of the apparatus or systems which makes use of the compressed air.

BACKGROUND ART

In aircraft, compressors are provided in association or integral with gas turbine engines in order to compress air for engine use and/or supply the compressed air to various apparatus in the aircraft for use thereby. For example, compressed air is supplied to the cabin of the aircraft to pressurize the cabin and supply cooled air thereto. The compressor is driven directly by the driveshaft of an aircraft engine or through a transmission device or the like.

Typically, such a compressor, in association with an aircraft engine, supplies more compressed air than is needed by the apparatus in the aircraft which makes use of the compressed air. The excess compressed air output by the compressor is supplied to a dump tube for dumping the excess compressed air to avoid compressor surge. Surges in the compressor occur during start-up of the aircraft engine and also when the demand for compressed air decreases due to the sudden decrease in operation of apparatus which makes use of the compressed air output by the compressor.

Various conventional apparatus have been proposed for eliminating surges in the compressed air output by a compressor during start-up of the compressor and during sudden decrease in operation of apparatus which makes use of the compressed air output by the compressor.

For example, U.S. Pat. No. 1,215,071 discloses an unloading valve for a compressor which automatically unloads a portion of the compressed air output from the compressor whenever the compressor stops its compressing action. Thus, the unloading valve disclosed by U.S. Pat. No. 1,215,071 facilitates the start-up of the compressor against pressure in the main lines or tank beyond the unloading device to which compressed air from the compressor is supplied.

The unloading valve disclosed by U.S. Pat. No. 1,215,071 suffers from the disadvantage of not providing apparatus which aids in eliminating surges in the compressed air under low flow conditions in which surge may occur during operation. This concept is only utilized when the compressor is shut down or inoperative.

U.S. Pat. No. 2,459,000 discloses a spill valve which is operated in response to a Venturi throat for controlling the pressurization of an aircraft cabin during periods of low altitude flying. Particularly the spill valve disclosed by U.S. Pat. No. 2,459,000 is used to dump compressed air during the periods of low altitude flying.

The apparatus disclosed by U.S. Pat. No. 2,459,000 suffers from the disadvantage of not providing apparatus for eliminating compressor surges during the start-up and operation of the compressor. Further, the apparatus disclosed by U.S. Pat. No. 2,459,000 does not disclose apparatus for reducing compressor dump flow when additional apparatus which makes use of the compressed air is suddenly started or when the operation of apparatus which makes use of the compressed air is increased while maintaining compressor surge margin.

U.S. Pat. No. 2,977,971 discloses a fluid distribution system and valves having an unloading valve interposed between a constant displacement pump and a distribution line. The valve disclosed by U.S. Pat. No. 2,977,971 is designed to prevent damage to the pump when pressure surges are encountered in the system. The unloading valve disclosed by U.S. Pat. No. 2,977,971 rapidly shifts between its loading and unloading position so that the flow of unloaded fluid is not throttled or graduated.

The fluid distribution system and valves disclosed by U.S. Pat. No. 2,977,971 suffers from the disadvantage that the apparatus disclosed thereby does not provide apparatus for eliminating surges during the start-up and operation of the compressor. Further, the fluid distribution system and valves disclosed by U.S. Pat. No. 2,977,971 suffers from the disadvantage of not providing apparatus for eliminating compressor surges while reducing the dumped air quantity when the system demand for compressed air has increased by either the start-up of additional apparatus which makes use of the compressed air or the increased operation of the apparatus which makes use of the compressed air.

U.S. Pat. No. 3,470,896 discloses a flow control system having main and base load pipes connected in parallel between a source of fluid supply and a discharge wherein the base load pipe has an orifice in which the difference in pressure between the high pressure side and the low pressure side of the orifice is used to control a valve in the main pipe thereby regulating the flow in the main pipe.

U.S. Pat. No. 3,470,896 suffers from the disadvantage of not providing apparatus which eliminates compressor surges while reducing the dumped air quantity when the system demand for compressed air during the start-up and operation of the compressor has increased. Further, the fluid flow control system disclosed by U.S. Pat. No. 3,470,896 suffers from the disadvantage of not providing apparatus which eliminates compressor surges while reducing the dumped air quantity when the system demand for compressed air has increased by either the start-up of additional apparatus which makes use of the compressed air or the increased operation of the apparatus using the compressed air.

U.S. Pat. No. 3,698,839 discloses a pressure equalizer for unloading a compressor during start-up having a Venturi throat valve which initially operates with equalized pressure across the Venturi throat valve so that back pressure is present on the compressor during start-up. The pressure differential across the Venturi throat valve of U.S. Pat. No. 3,698,839 is developed in the discharge line by a spring-bias axially movable nozzle which is movable in opposition to its spring bias and by a force resulting from the pressure differential to an operating position effective to close the vent and interrupt the equalization passage.

The pressure equalizer disclosed by U.S. Pat. No. 3,698,839 suffers from the disadvantage of not providing apparatus which eliminates compressor surge during the start-up and/or compressor operation. This device is for simply unloading the compressor during start-up and until a minimum flow is obtained. The intent of the pressure equalizer disclosed by U.S. Pat. No. 3,698,839 is to reduce motor sizing and not to prevent compressor surges.

DISCLOSURE OF THE INVENTION

The present invention provides antisurge apparatus for controlling the occurrence of surges in compressed air output by a compressor. Particularly, the present invention provides an antisurge apparatus which eliminates surges in the compressed air output by the compressor while minimizing the amount of compressed air being dumped.

The antisurge apparatus of the present invention eliminates surges occurring in the compressed air output by the compressor during start-up of the compressor. The antisurge apparatus of the present invention eliminates surges in the compressed air output by the compressor during start-up of the compressor by dumping excess compressed air until the aircraft systems demand reaches a predetermined minimum requirement.

Further, the antisurge apparatus of the present invention minimizes the usage of compressed air output by the compressor when the demand for compressed air is increased by either the sudden start-up of additional apparatus which makes use of the compressed air or the increased operation of the apparatus using the compressed air. The antisurge apparatus of the present invention eliminates surges in compressed air while minimizing its consumption by decreasing the amount of compressed air being dumped in proportion to the increase in system or apparatus demand. The increase in system or apparatus demand for compressed air output by the compressor is detected by a change in flow in the compressed air.

Thus, the antisurge apparatus of the present invention as described above prevents surges in the compressed air output by the compressor occurring during all phases of operation while minimizing air consumption of the compressor.

In the present invention, the compressed air output by the compressor is divided into a first portion which is supplied to a dump tube for dumping excess compressed air to insure compressor surge margin and a second portion supplied to apparatus or systems which makes use of the compressed air.

The antisurge apparatus of the present invention includes a flow change sensing unit for sensing a change in flow of the second portion of compressed air output by the compressor and supplying a flow change signal indicating an amount of the change in flow. The antisurge apparatus of the present invention also includes a dumping control unit for controlling an amount of the first portion of compressed air to be supplied to the dump tube in response to the flow change signal.

The flow change sensing unit for sensing a change in flow of the second portion of compressed air is accomplished by a Venturi positioned within the second portion of compressed air. First and second pressure conduits are provided in the present invention with the first pressure conduit communicating with the second portion of compressed air flowing through the Venturi throat and the second pressure conduit communicating with the second portion of compressed air upstream from the Venturi throat. A change in flow is sensed by sensing a difference in pressure between a second pressure indicated by the second pressure conduit at the upstream position in the second portion of compressed air and a first pressure indicated by the first pressure conduit in the Venturi throat. The first and second pressures supplied by the first and second pressure conduits are provided to a pilot valve.

The first pressure is supplied to a first chamber of the pilot valve and the second pressure is provided to a second chamber of the pilot valve. The first and second chambers of the pilot valve are separated by a diaphragm or a similar device which has connected thereto a valve member for controlling pressure in a signal conduit.

A difference in pressure between the first chamber and the second chamber causes movement of the valve member between a position which relieves pressure in the signal conduit and a position which does not relieve pressure in the signal conduit.

The dumping control unit for controlling an amount of the first portion of compressed air to be supplied to the dump tube is provided by a pressure balanced poppet valve. The pressure balanced poppet valve includes a first chamber which communicates with the first portion of compressed air output by the compressor and with one end of the signal conduit.

A second chamber of the pressure balanced poppet valve communicates with the other end of the signal conduit. The first chamber of the pressure balanced poppet valve has an opening for permitting the first chamber to communicate with a third chamber which communicates with the dump tube. A diaphragm or similar device separates the second chamber from the third chamber which communicates with the dump tube.

The pressure balanced poppet valve includes a valve member positioned in the opening between the first chamber and the third chamber of the pressure balanced poppet valve. The valve member is biased by a resilient device to a position which closes the opening between the first chamber and the third chamber of the pressure balanced poppet valve. The valve member is attached to the diaphragm or similar device which separates the second chamber from the third chamber of the pressure balanced poppet valve.

During start-up of the antisurge apparatus of the present invention, compressed air output by the compressor is supplied as the first portion of compressed air to the first chamber of the pressure balanced poppet valve. Also, a portion of the first portion of compressed air flows into the one end of the signal conduit. An other end of the signal conduit as described above communicates with the second chamber of the pressure balanced poppet valve.

In the present invention during start-up, as the pressure of compressed air output by the compressor begins to rise, compressed air flowing in the signal conduit begins to charge the second chamber of the pressure balanced poppet valve due to the fact that the valve member of the pilot valve remains in a position which does not relieve pressure in the signal conduit. The resilient device of the pressure balanced poppet valve biases the valve member of the pressure balanced poppet valve to close the opening between the first chamber and the third chamber of the pressure balanced poppet valve. The third chamber communicates with the dump tube.

Once the pressure in the second chamber of the pressure balanced poppet valve reaches a first predetermined pressure, the valve member of the pressure balanced poppet valve will begin to open thereby permitting a portion of the first portion of compressed air to be supplied to the dump tube for dumping. The valve member of the pressure balanced poppet valve will be in the full open position once the pressure in the second chamber has reached a second predetermined pressure which is larger than the first predetermined pressure.

The above-described action provided by the pressure balanced poppet valve during start-up of the compressor eliminates surges of the compressor caused by lack of flow demand.

In the present invention when the demand for compressed air by apparatus or systems increases or initiates then a difference in pressure appears between the first and second pressures measured, by the Venturi, in the second portion of compressed air output by the compressor. The difference in pressure between the first and second pressures affects the pressure within the first and second chambers of the pilot valve. The difference in pressure between the first and second chambers of the pilot valve causes the valve member of the pilot valve to move toward the position relieving pressure in the signal conduit. Pressure being relieved in the signal conduit by the pilot valve reduces the pressure in the second chamber of the pressure balanced poppet valve thereby causing the valve member of the pressure balanced poppet valve to move toward the position closing the opening between the first and third chambers of the pressure balanced poppet valve.

Movement of the valve member towards the closed position of the pressure balanced poppet valve reduces the amount of the first portion of compressed air supplied to the dump tube for dumping. This reduction in flow is directly proportional to the increase in systems or apparatus flow demand.

Thus, in the present invention by use of the pressure balanced poppet valve and the pilot valve compressor surges are eliminated while air consumption is minimized under all conditions.

A filter is provided in the signal conduit of the present invention to filter out particulate matter in the compressed air. Also, a control orifice is provided in the signal conduit of the present invention to control the amount of compressed air from the first portion of compressed air being input to the signal conduit.

BRIEF DESCRIPTION OF THE DRAWINGS

The features of the present invention which are believed to be novel are set forth with particularity in the appended claims. The invention may be best understood, however, by reference to the following description in conjunction with the accompanying drawing in which:

BEST MODE FOR CARRYING OUT THE INVENTION

Figure 1:
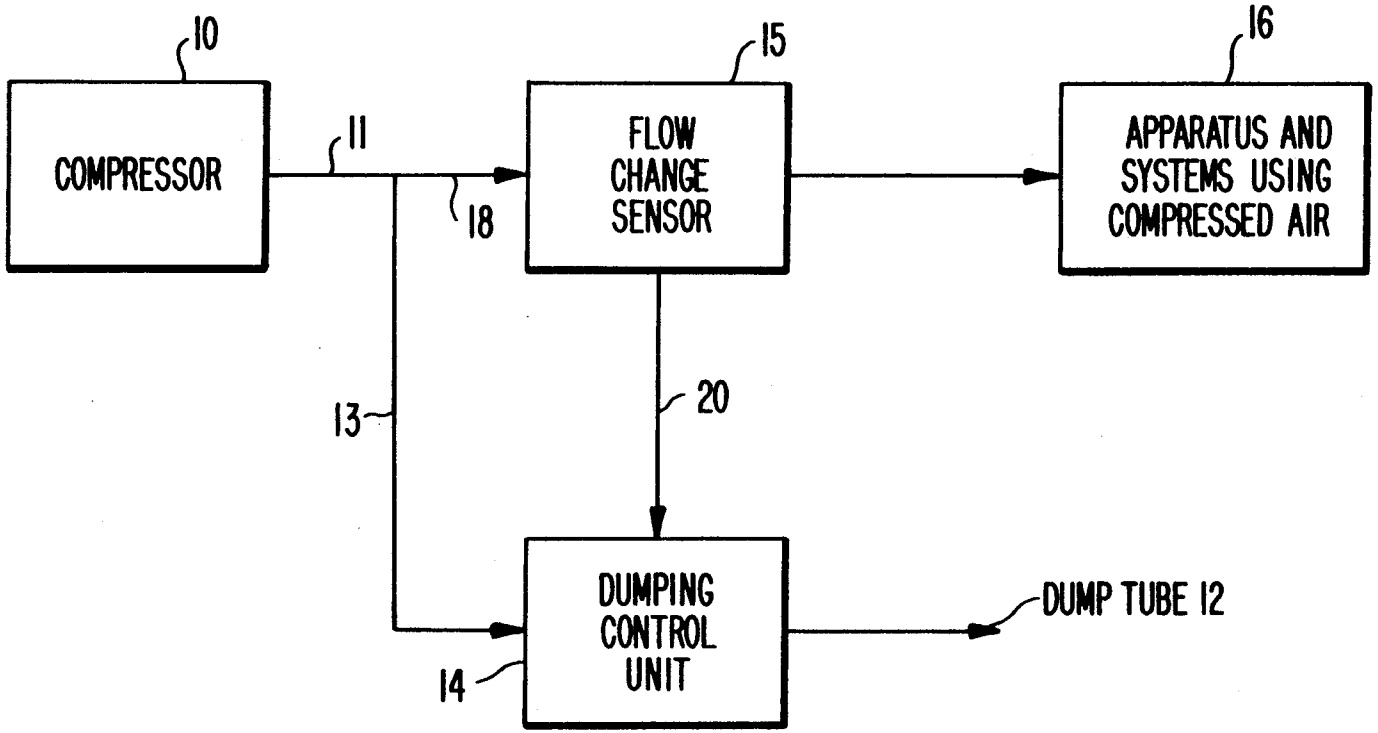
FIG. 1 illustrates a block drawing of the antisurge apparatus of the present invention.

FIG. 1 illustrates in block diagram form the antisurge apparatus of the present invention. The antisurge apparatus of the present invention controls the use of compressed air output by a compressor 10 on conduit 11. Compressed air output by the compressor 10 on conduit is divided into a first portion of compressed air which is supplied to a dump tube 12. The dump tube 12 dumps excess compressed air output by the compressor 10 to prevent compressor surge. The first portion of compressed air is supplied to the dump tube 12 by a conduit 13 which communicates with the conduit and the dump tube 12 through a dumping control unit 14 which will be described below.

A second portion of compressed air is supplied to a flow change sensing unit 15 which will be described in detail below and apparatus or systems 16 which makes use of the compressed air by conduit 18. Apparatus or systems 16 may for example be those for cooling the cabin of an aircraft or any other such apparatus which operates using the compressed air.

Flow change sensing unit 15 is provided in the present invention for sensing a change in flow of the second portion of compressed air output by the compressor 10 and supplying a flow change signal 20 indicating an amount of change in flow of the second portion of compressed air to dumping control unit 14 which will be described below.

Dumping control unit 14 is provided in the present invention for controlling an amount of the first portion of compressed air to be supplied to the dump tube 12 in response to the flow change signal 20.

The apparatus of the present invention as shown in FIG. 1 eliminates surges occurring in the compressor 10 which supplies compressed air to the apparatus or systems 16. This function is accomplished by the dumping control unit 14 of the present invention.

Further, the apparatus of the present invention eliminates surges occurring in the compressor 10 which supplies compressed air to the apparatus 16, while minimizing air consumption when demand for compressed air increases, by sensing a change in flow in the second portion of compressed air, and proportionally reducing the amount of the first portion of compressed air being supplied to the dump tube. The reduction in the amount of the first portion of compressed air being supplied to the dump tube 12 is performed in accordance with the sensed change in flow. The change in flow in the second portion of compressed air in conduit 18 is indicative of an increase in demand for compressed air. The increase in demand for compressed air is caused by either the sudden start-up of additional apparatus or systems which makes use of the compressed air or the increased operation of the apparatus or systems using the compressed air.

Figure 2:
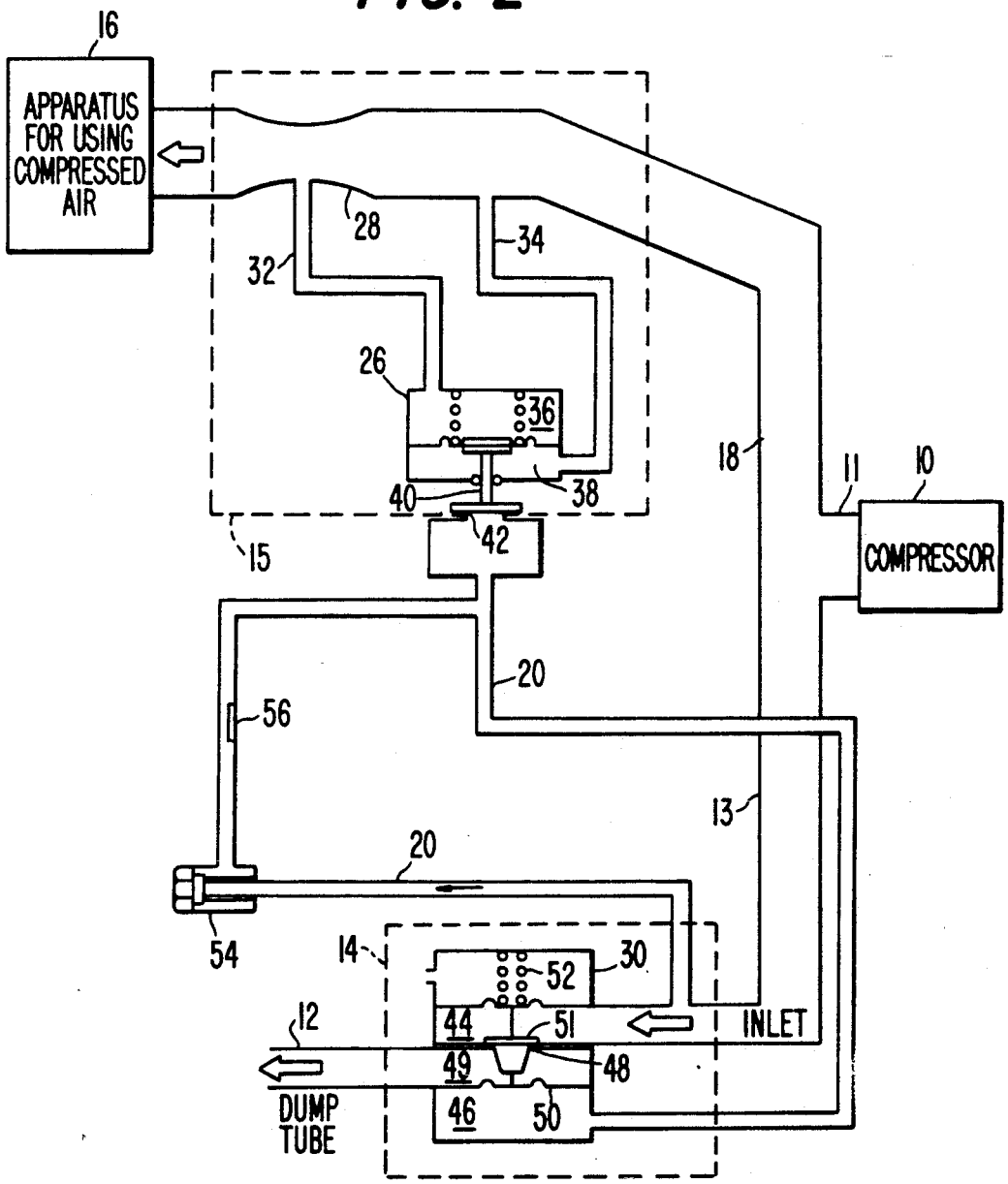
FIG. 2 illustrates a schematic drawing of the pilot valve and pressure balanced poppet valve of the present invention.

A detailed schematic diagram of the present invention is shown in FIG. 2. As shown in FIG. 2, the flow change sensing unit 15 is accomplished by a pilot valve 26 and a Venturi 28. The dumping control unit 14 is accomplished by a pressure balanced poppet valve 30.

The Venturi 28 is positioned within the second portion of compressed air flowing in conduit 18. The flow change sensing unit 15 also includes a first pressure conduit 32 and a second pressure conduit 34. The first pressure conduit 32 communicates with the Venturi throat 28 so as to measure the static pressure at the Venturi throat 28. The second pressure conduit 34 communicates with the conduit 18 so as to measure compressed air pressure upstream from the Venturi throat 28. Compressed air flowing in the Venturi throat 28 generates the delta (change in pressure) between the first and second pressures, respectively. When an increase in demand for compressed air occurs in the conduit 18 a difference in pressure appears between the first pressure indicated by the first pressure conduit 32 and the second pressure indicated by the second pressure conduit 34.

The first and second pressure conduits 32 and 34, respectively, communicate with the pilot valve 26. The first pressure conduit 32 communicates with a first pilot valve chamber 36 of the pilot valve 26. The second pressure conduit 34 communicates with a second pilot valve chamber 38. The first and second pilot valve chambers 36 and 38 respectively of the pilot valve 26 are separated by a movable diaphragm or similar device which has connected thereto a pilot valve member 40.

The first pressure supplied by the first pressure conduit 32 pressurizes the first pilot valve chamber 36 of the pilot valve 26 and the second pressure supplied by the second pressure conduit 34 pressurizes the second pilot valve chamber 38 of the pilot valve 26. A difference in pressure between the first pilot valve chamber 36 and the second pilot valve chamber 38 caused by the flow of air causes movement of the pilot valve member 40 between an open position and a closed position relative to a valve member seat 42.

The valve member seat 42 is positioned about an opening in a signal conduit 20. Thus, the pilot valve member 40 when in the open position relieves pressure in the signal conduit 20 and when in the closed position prevents the relief of pressure in the signal conduit 20.

The dumping control unit 14 as described above is accomplished by a pressure balanced poppet valve 30. The pressure balanced poppet valve includes a first poppet valve chamber 44 which communicates with conduit !3 which supplies the first portion of compressed air output by the compressor. The first poppet valve chamber 44 also communicates with one end of the signal conduit 20.

A second poppet valve chamber 46 is also provided in the poppet valve 30. The second pressure balanced poppet valve chamber 46 communicates with the other end of the signal conduit 20. The first poppet valve chamber 44 has an opening 48 for communicating with a third poppet valve chamber 49 which communicates with the dump tube 12. A movable diaphragm or similar device 50 separates the second poppet valve chamber 46 from the third poppet valve chamber 49.

The pressure balanced poppet valve 30 further includes a poppet valve member 51 positioned in the opening between the first poppet valve chamber 44 and the third poppet valve chamber 49. The poppet valve member 51 is biased by a resilient device 52 to a position which closes the opening 48 between the first poppet valve chamber 44 and the third poppet valve chamber 49. The poppet valve member 51 is attached to the movable diaphragm 50 or similar device which separates the second poppet valve chamber 46 from the third poppet valve chamber 49.

A filter 54 is provided in the signal conduit 20 for filtering out particulate matter in the compressed air flowing within the signal conduit 20. Also, a control orifice 56 is provided in the signal conduit 20 to control the amount of compressed air flowing within the signal conduit 20.

During start-up of the antisurge apparatus of the present invention, compressed air output by the compressor 10 is supplied to the first poppet valve chamber 44 of the pressure balanced poppet valve 30 as the first portion of compressed air through conduits 11 and 13. Also, a portion of the first portion of compressed air flows into the one end of the signal conduit 20. The other end of the signal conduit 20 as shown in FIG. 2 communicates with the second poppet valve chamber 46 of the pressure balanced poppet valve 30.

In the present invention during start-up, as the compressed air output by the compressor 10 begins to rise, the portion of the compressed air of the first portion of compressed air flowing in the signal conduit 20 begins to charge the second poppet valve chamber 46 of the pressure balanced poppet valve 30 due to the fact that the pilot valve member 40 remains in a closed position which does not relieve pressure in the signal conduit 20. The resilient device 52 of the pressure balanced poppet 30 biases the pressure balanced poppet valve member 51 to close the opening between the first poppet valve chamber 44 and the third poppet valve chamber 49 of the pressure balanced poppet valve 30.

Once the pressure in the second poppet valve chamber 46 reaches a first predetermined pressure, the pressure balanced poppet valve member 51 will begin to move to a position exposing the opening 48 between the first poppet valve chamber 44 and the third poppet valve chamber 49. Thus, a portion of the first portion of compressed air to be supplied to the dump tube 12 is permitted to flow through the opening 48 to the dump tube 12. The pressure balanced poppet valve member 5 will be in the full open position once the pressure in the second poppet valve chamber 46 reaches a second predetermined pressure which is larger than the first predetermined pressure.

The first predetermined pressure can be set to a pressure range of for example 2–4 psig and the second predetermined pressure can be to a pressure of for example set at 7 psig.

In the present invention, during normal continuous operation the pilot valve member 40 remains in the closed position thereby not relieving pressure in the signal conduit 20 and the pressure balanced poppet valve member 51 remains in the open position thereby permitting the first portion of compressed air to be supplied to the dump tube 12 for dumping.

In the present invention when the demand for compressed air initiates or increases, then a difference in pressure appears between the first pressure supplied by the first pressure conduit 32 and the second pressure supplied by the second pressure conduit 34. As described above, the first pressure is supplied by the first pressure conduit 32 to the first pilot valve chamber 36 and the second pressure is supplied by the second pressure conduit 34 to the second pilot valve chamber 38.

The difference in pressure between the first and second pressures effects the pressure within the first pilot valve chamber 36 and the second pilot valve chamber 38. The difference in pressure between the first pilot valve chamber 36 and the second pilot valve chamber 38 of the pilot valve 26 causes the pilot valve member 40 to move toward the open position thereby relieving pressure in the signal conduit 20. The relief of pressure in the signal conduit 20 reduces the pressure in the second poppet valve chamber 46 of the poppet valve 30. The reduction in pressure in the second poppet valve chamber 46 of the pressure balanced poppet valve 30 causes the poppet valve member 51 to move toward the position closing the opening 48 between the first poppet valve chamber 34 and the third poppet valve chamber 49. Movement of the poppet valve member 51 toward the position closing the opening 48 between the first and third poppet valve chambers 44 and 49, respectively, reduces the amount of the first portion of compressed air supplied to the dump tube 12 for dumping. This reduction is directly proportional to the increase in demand by the apparatus or systems of the second portion of compressed air.

Thus, by use of the present invention as described above, surges occurring in the compressor are eliminated while minimizing the air consumption as system or apparatus demand increases.

In the present invention, the reduction of the amount of compressed air being dumped as the demand for compressed air increases allows for minimal usage of bleed air while assuring that sufficient compressor stall margin is maintained.

While the present invention has been described in terms of its preferred embodiment, it should be understood that numerous modifications may be made thereto without departing from the spirit and scope of the invention as described in the appended claims. For example, the present invention may be used in any application which requires a system for controlling the amount of compressed air being dumped. It is intended that all such modifications fall within the scope of the appended claims.

I claim:

1. An antisurge apparatus for eliminating surges in compressed air output by a compressor, wherein the compressed air output by the compressor is divided into a first portion of compressed air being supplied to a dump tube for dumping the first portion of compressed air as excess compressed air and a second portion of compressed air being supplied to apparatus or systems which makes use of the compressed air, said antisurge apparatus comprising:

means for sensing a change in flow of said second portion of compressed air output by said compressor and supplying a flow change signal in the form of pressure indicating an amount of said change in flow; and means for controlling an amount of said first portion of compressed air being supplied to said dump tube in response to said flow change signal;

wherein said means for sensing comprises:

a Venturi for receiving said second portion of compressed air and sensing a change in flow in said second portion of compressed air, and a pilot valve which supplies said flow change signal in response to the change in flow sensed by the Venturi;

wherein said means for controlling is provided by a pressure balanced poppet valve for controlling the amount of said first portion of compressed air being supplied to said dump tube in response to said flow change signal;

wherein said flow change signal is provided by a signal conduit to said pressure balanced poppet valve; and wherein said pressure balanced poppet valve comprises:

a first poppet valve chamber for receiving said first portion of compressed air and communicating with one end of said signal conduit;

a second poppet valve chamber which communicates with the other end of said signal conduit, and a third poppet valve chamber which communicates with said dump tube.

2. The antisurge apparatus according to claim 1, wherein a first pressure indicating a pressure of said second portion of compressed air flowing in said Venturi is supplied to said pilot valve and a second pressure indicating a pressure of said second portion of compressed air flowing at a point upstream from said Venturi is supplied to said pilot valve.

3. The antisurge apparatus according to claim 2, wherein said first pressure is supplied to a first pilot valve chamber of said pilot valve and said second pressure is supplied to a second pilot valve chamber of said pilot valve.

4. The antisurge apparatus according to claim 3, wherein said pilot valve further comprises:

a movable diaphragm or similar device which separates said first pilot valve chamber from said second pilot valve chamber; and a pilot valve member attached to said diaphragm for moving between a closed position and an open position.

5. The antisurge apparatus according to claim 4, wherein said signal conduit includes an opening which is disposed near said pilot valve member of said pilot valve; and wherein said closed position of said pilot valve member closes said opening and said open position of said pilot valve member opens said opening.

6. An antisurge apparatus for eliminating surges in compressed air output by a compressor, wherein the compressed air output by the compressor is divided into a first portion of compressed air being supplied to a dump tube for dumping the first portion of compressed air as excess compressed air and a second portion of compressed air being supplied to apparatus or system switch makes use of the compressed air, said antisurge apparatus comprising:

means for sensing a change in flow of said second portion of compressed air output by said compressor and supplying a flow change signal in the form of pressure indicating an amount of said change in flow; and means for controlling an amount of said first portion of compressed air being supplied to said dump tube in response to said flow change signal;

wherein said means for sensing comprises:

a Venturi for receiving said second portion of compressed air and sensing a change in flow in said second portion of compressed air, and a pilot valve which supplies said flow change signal in response to the change in flow sensed by the Venturi;

wherein said means for controlling is provided by a pressure balanced poppet valve for controlling the amount of said first portion of compressed air being supplied to said dump tube in response to said flow change signal;

wherein a first pressure indicating a pressure of said second portion of compressed air flowing in said Venturi is supplied to said pilot valve and a second pressure indicating a pressure of said second portion of compressed air flowing at a point upstream from said Venturi is supplied to said pilot valve;

wherein said first pressure is supplied to a first pilot valve chamber of said pilot valve and said second pressure is supplied to a second pilot valve chamber of said pilot valve;

wherein said pilot valve further comprises:

a movable diaphragm or similar device which separates said first pilot valve chamber from said second pilot valve chamber, and a pilot valve member attached to said diaphragm for moving between a closed position and an open position;

wherein said flow change signal is provided by a signal conduit to said pressure balanced poppet valve;

wherein said signal conduit includes an opening which is disposed near said pilot valve member of said pilot valve;

wherein said closed position of said pilot valve member closes said opening and said opening position of said pilot valve member opens said opening; and wherein said pressure balanced poppet valve comprises:

a first poppet valve chamber for receiving said first portion of compressed air communicating with one end of said signal conduit, a second poppet valve chamber which communicates with the other end of said signal conduit, and a third poppet valve chamber which communicates with said dump tube.

7. The antisurge apparatus according to claim 6, wherein said pressure balanced poppet valve further comprises:

an opening between said first poppet valve chamber and said third poppet valve chamber; and a diaphragm or similar device which separates said second poppet valve chamber from said third poppet valve chamber.

8. The antisurge apparatus according to claim 7, wherein said pressure balanced poppet valve further comprises:

a poppet valve member disposed in said opening between said first and third poppet valve chamber;

wherein said poppet valve member is attached to said diaphragm or similar device separating said second poppet valve chamber from said third poppet valve chamber; and wherein said poppet valve member is biased to a position which closes said opening between said first and third poppet valve chambers.

9. The antisurge apparatus according to claim 8, wherein said signal conduit has disposed therein a filter for filtering particulate matter from said compressed air flowing therein.

10. The antisurge apparatus according to claim 9, wherein said signal conduit includes an orifice for controlling the amount of compressed air flowing in said signal conduit.

* * * * *